US006357637B1

(12) United States Patent
Urlau et al.

(10) Patent No.: US 6,357,637 B1
(45) Date of Patent: Mar. 19, 2002

(54) METHOD AND CASTING NOZZLE FOR CASTING-ON A METAL STRIP WHICH IS CLOSE TO FINAL DIMENSIONS

(75) Inventors: Ulrich Urlau, Moern; Joachim Kroos, Meine; Reinhard Scholz; Karl-Heinz Spitzer, both of Clausthal-Zellerfeld, all of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/529,523

(22) PCT Filed: Sep. 11, 1998

(86) PCT No.: PCT/DE98/02763

§ 371 Date: Jul. 25, 2000

§ 102(e) Date: Jul. 25, 2000

(87) PCT Pub. No.: WO99/19098

PCT Pub. Date: Apr. 22, 1999

(30) Foreign Application Priority Data

Oct. 13, 1997 (DE) ..... 197 46 728

(51) Int. Cl.[7] ..... B22D 37/00

(52) U.S. Cl. ..... 222/590; 222/594; 164/463; 164/479

(58) Field of Search ..... 222/590, 591, 222/594; 164/463, 479

(56) References Cited

U.S. PATENT DOCUMENTS 4,649,984 A * 3/1987 Bedell et al. ..... 164/463
5,355,937 A * 10/1994 Mueller et al. ..... 164/479
5,915,459 A * 6/1999 Urlau et al. ..... 164/479

* cited by examiner

*Primary Examiner*—Scott Kastler
(74) *Attorney, Agent, or Firm*—Cohen, Pontani, Lieberman & Pavane

(57) ABSTRACT

A method and a casting nozzle for starting the casting of a metal strip close its final dimensions. The method includes leading a melt via a melt-feed vessel into a pouring chamber of a siphon vessel. The melt from the pouring chamber is led onto a cooled transport belt via casting nozzle and a main chamber of the siphon vessel which can be put under vacuum. The pouring chamber and the main chamber of the siphon vessel are filled with the melt up to a top of the siphon. Before the melt flows over the top of the siphon a vacuum is induced in the main chamber by actuating a vacuum device connected to the main chamber. After the melt has flowed over the top of the siphon the melt stream is led through the casting nozzle so that the nozzle cross-section closes in the manner of a plug. The vacuum is increased depending on position of the plug in the casting nozzle until there is in the melt stream a hydraulic connection between the steam inlet and the stream outlet. The vacuum is adjusted so that the melt flows out of the opening of the casting nozzle. The melt level in the pouring chamber is kept to the value at which an inflowing melt stream is equal to an outflowing melt stream.

14 Claims, 8 Drawing Sheets

Fig. 1.1
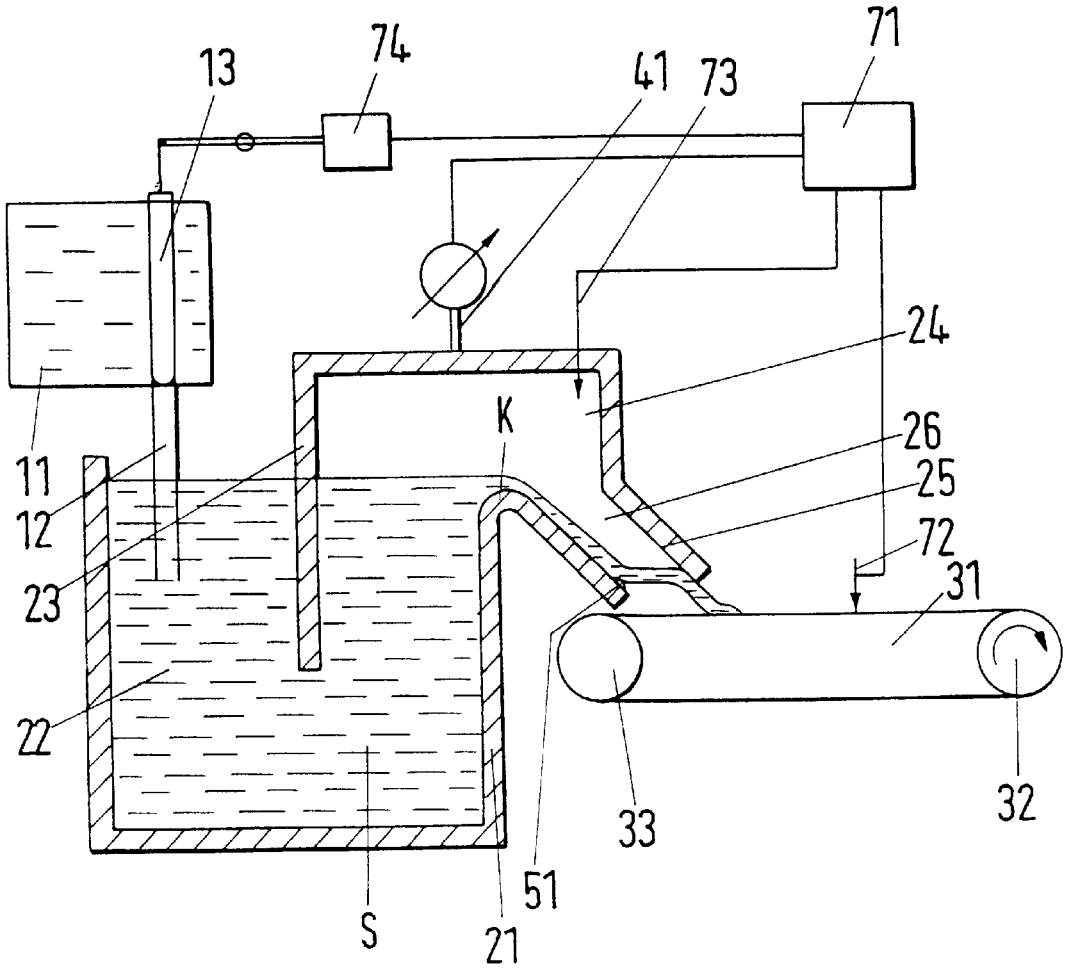

Fig. 1.2
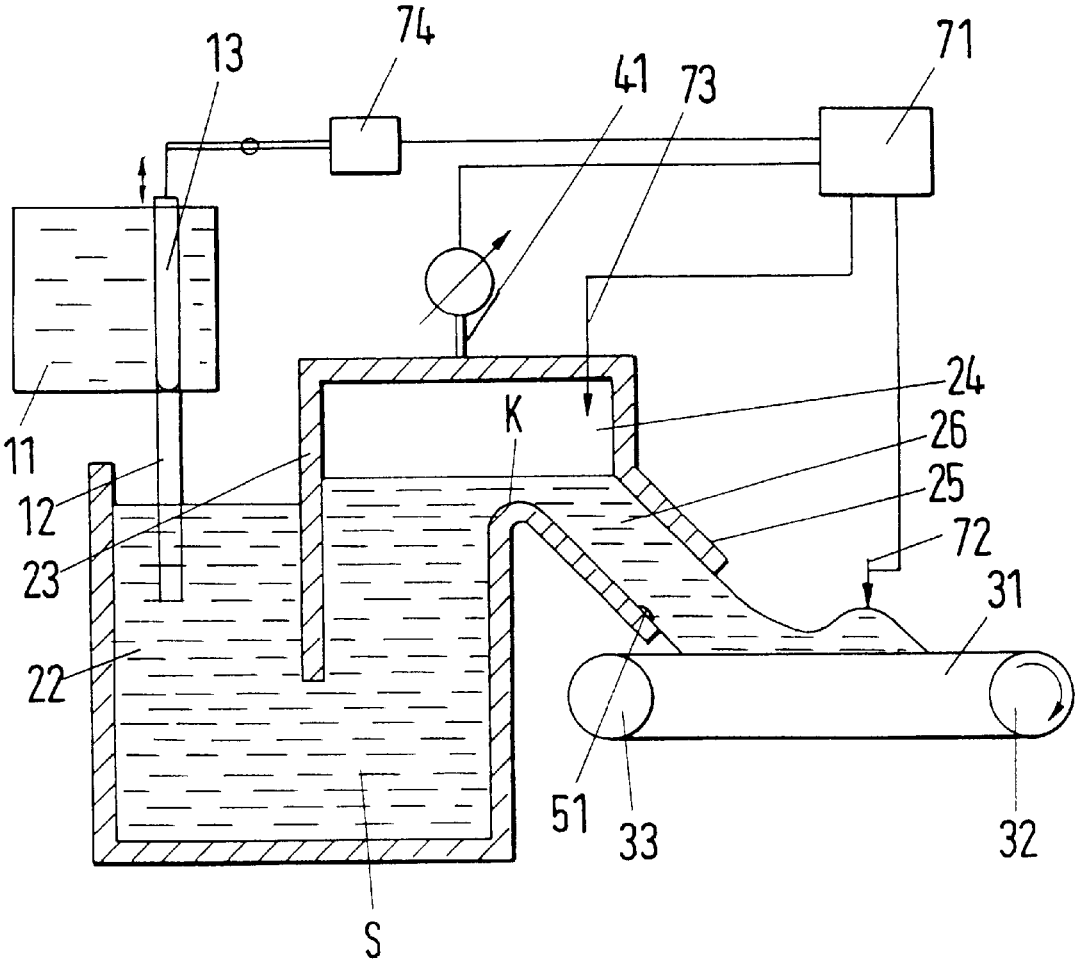

Fig. 1.3
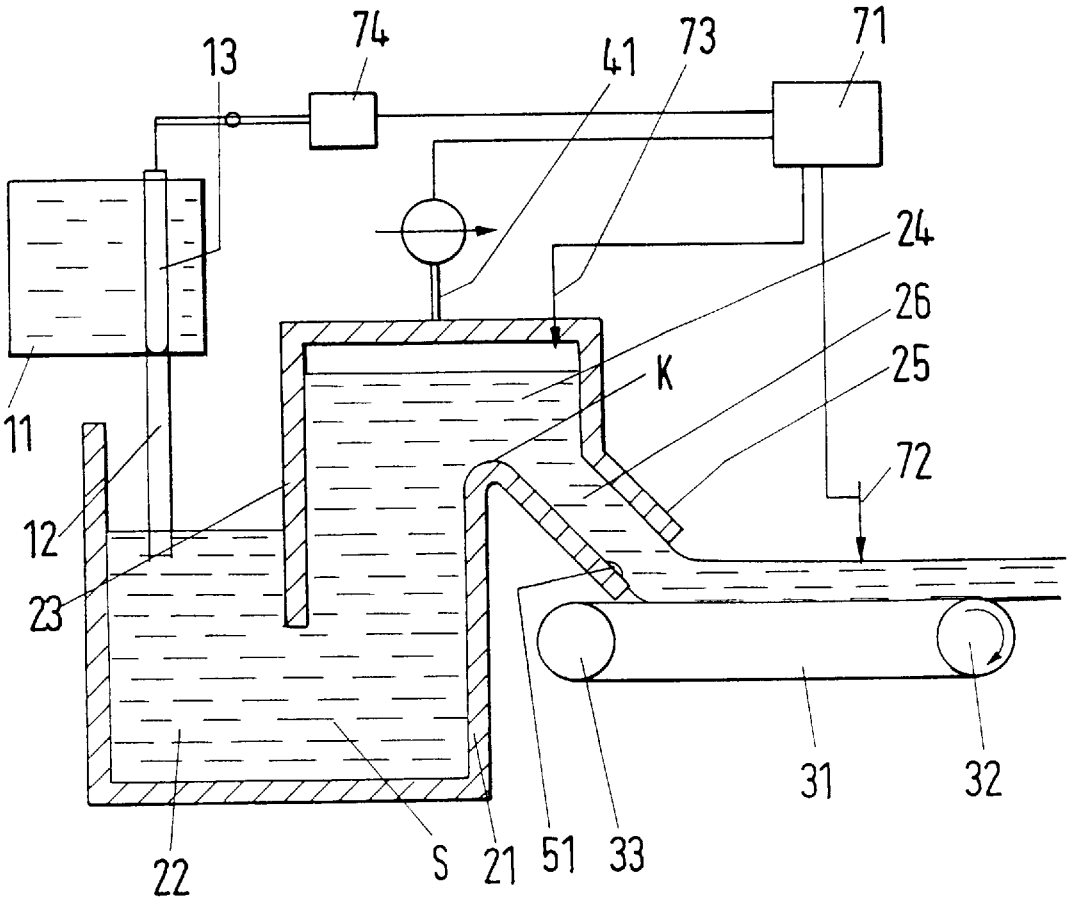

Fig. 2.1
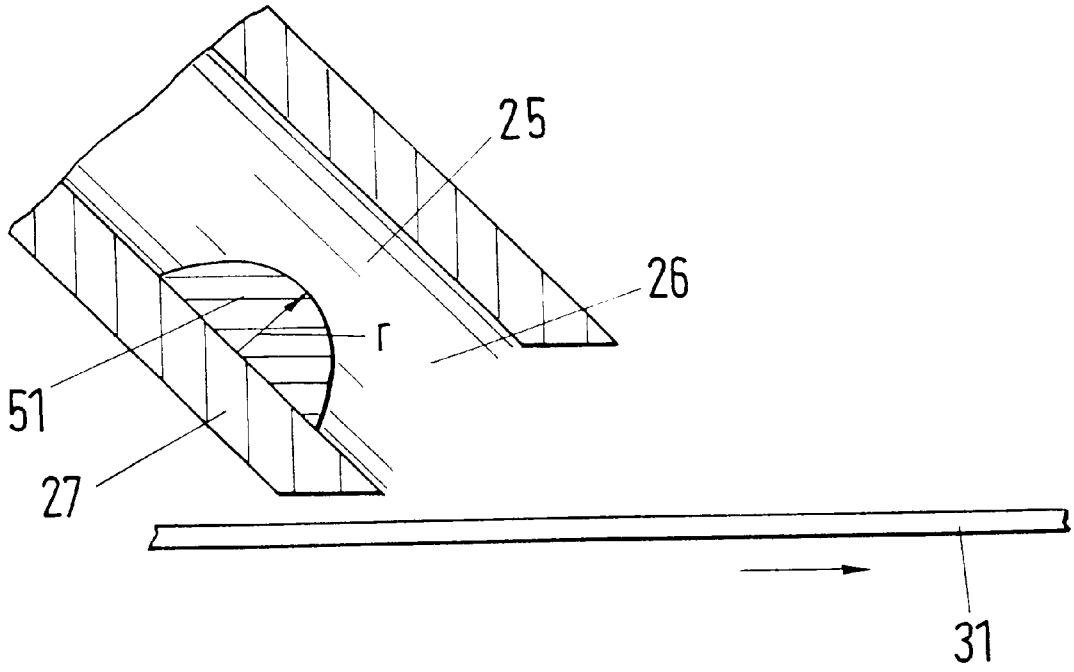

Fig. 2.2
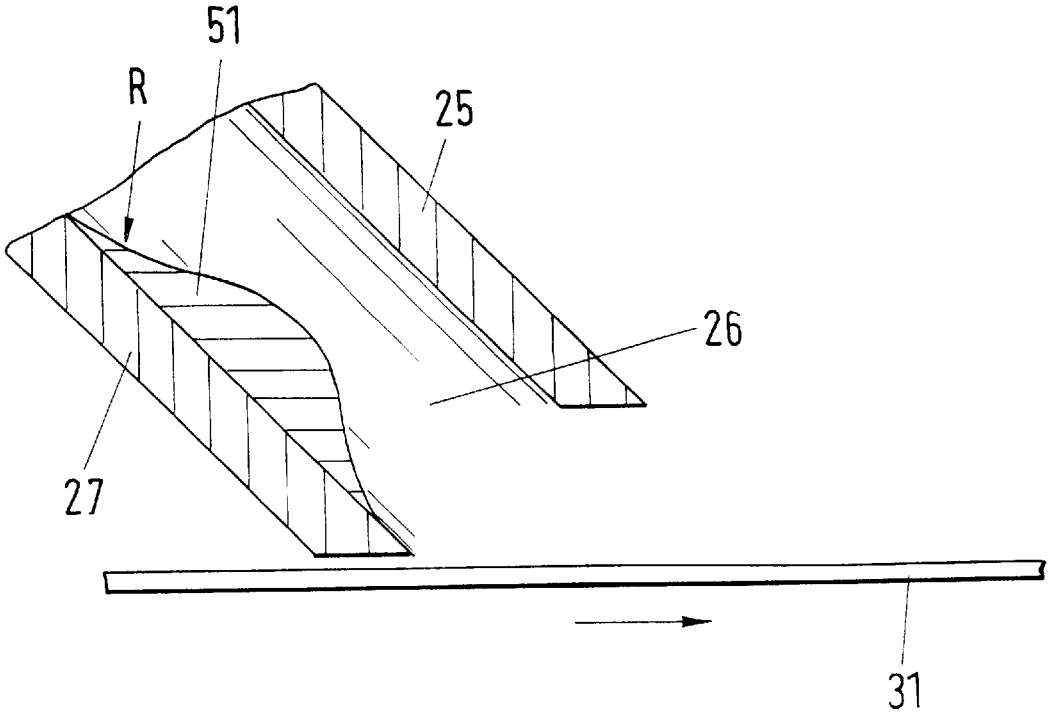

Fig. 2.3
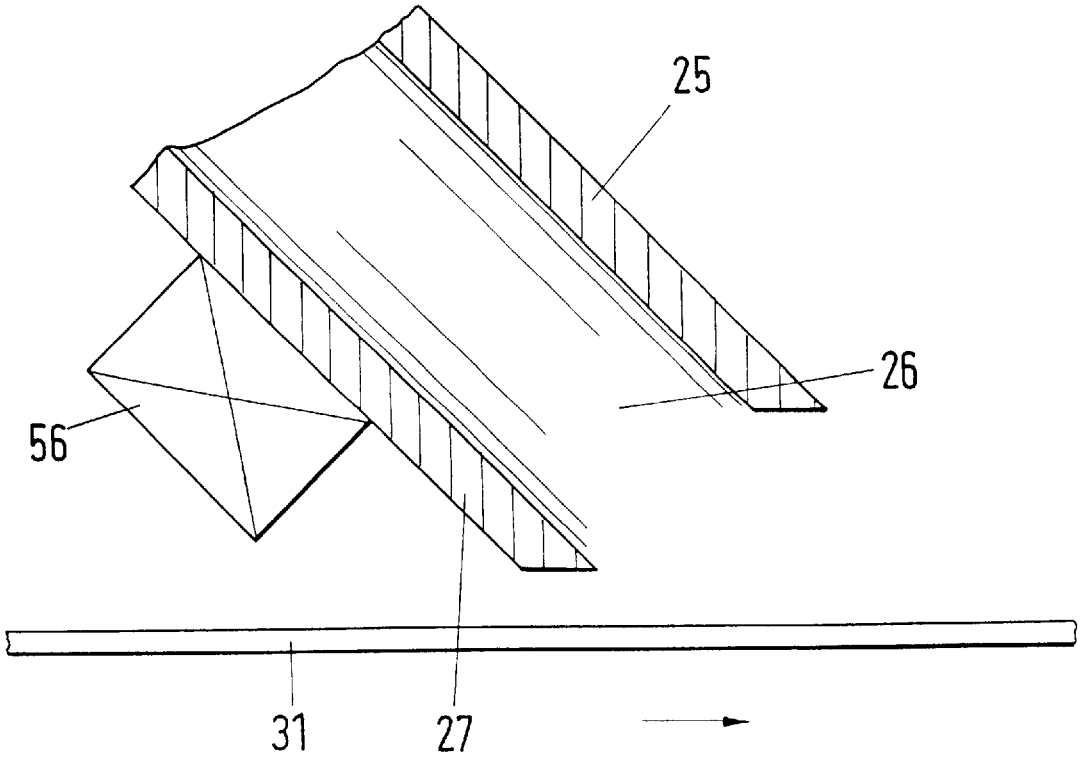

Fig. 3.1
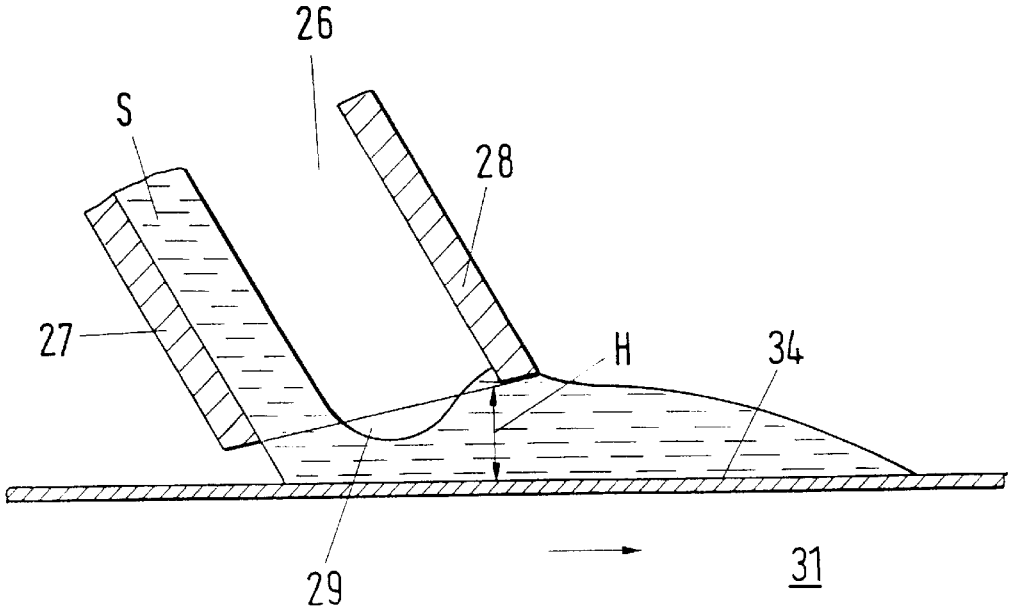

Fig. 3.2
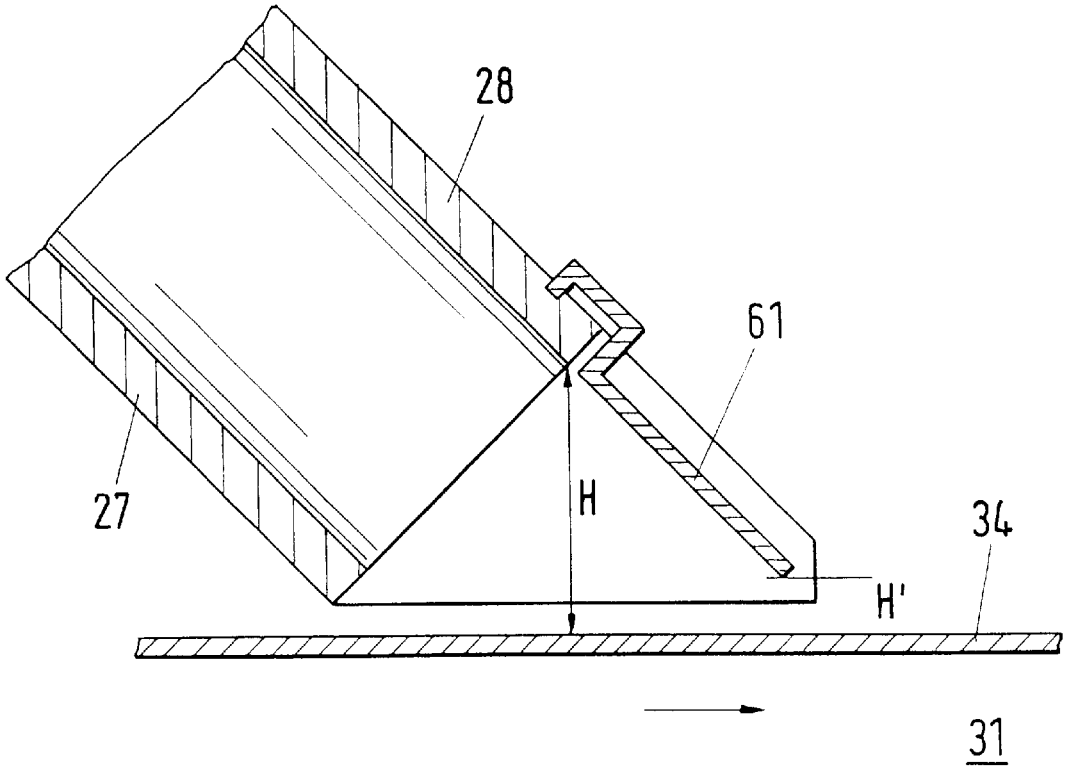

METHOD AND CASTING NOZZLE FOR CASTING-ON A METAL STRIP WHICH IS CLOSE TO FINAL DIMENSIONS

This application is a 371 of PCT/DE98/02763, filed on Sep. 11, 1998.

BACKGROUND OF THE INVENTION

1. Field of the Invention

The invention relates to a method of starting to cast a metal strip close to its final dimensions, in which the melt, in particular steel, is led via a melt feed vessel into a pouring chamber of a siphon-like vessel and from this pouring. The invention further relates a casting nozzle via a main chamber which can be put under vacuum, and to a casting nozzle for implementing the method.

2. Discussion of the Prior Art

German references DE 43 44 953 discloses a method, including the device necessary for this, for starting to cast a metal strip close to its final dimensions, in which a shut-off element is provided in the casting nozzle in the vicinity of the opening, with which element the casting nozzle can be shut off and is opened like a slot when starting to cast.

In rough environments, shut-off elements are subjected to extremely high loadings and therefore require intensive maintenance. In addition, qualified operating personnel are needed in order to run the correct program for the slot-like opening in the casting channel.

SUMMARY OF THE INVENTION

The object of the present invention is to provide a method with a corresponding device for starting to cast a metal strip close to its final dimensions, which permits the strip casting plant to be started up reliably using a constructionally simple and low-maintenance device.

According to the invention, in the siphon-like vessel, the pouring chamber and therefore the main chamber are filled until the liquid melt flows over the top of the siphon into the casting nozzle. As the melt flows out over the underside of the channel of the casting nozzle, the melt stream is led through the casting nozzle in such a way that its cross section closes in the manner of a plug.

For this purpose, first of all means are provided which deflect the melt stream flowing out two-dimensionally in the form of a ski jump, so that a plug is formed in the casting channel. The deflection can also be brought about by switching on a magnet arranged outside the casting nozzle.

In order to form the plug in the opening area of the casting nozzle, it is proposed to configure the opening in such a way that, essentially by means of a defined spacing of the top of the channel of the casting nozzle, as the melt stream encounters the upper run of the endless belt, it is deflected in such a way that the entire opening briefly fills up with melt and forms a plug.

The plug is maintained by the vacuum produced during the start-up by the vacuum pump connected to the main chamber, and is enlarged by the melt which subsequently flows, a small proportion of the melt being discharged onto the endless belt. After a reliable hydraulic connection in relation to the melt stream has been formed between the inlet into the pouring chamber and the outlet via the opening of the casting channel, the vacuum is adjusted so that the main chamber is adequately supplied with melt and the level in the pouring chamber is kept slightly above the height of the cast strip. After the casting relationships have stabilized, the vacuum device can be switched off, being used only in the event of any leakage. The entire regulation of the melt feed is carried out directly by measuring the level in the pouring chamber or measuring the height of the finished strip.

If an elevated section similar in shape to a ski jump is used on the underside of the channel, this section is configured in such a way that it does not hamper the melt flow during normal operation but effects the reliable formation of a plug at the beginning of casting.

To the extent that the plug is intended to be formed only in the opening area, this is ensured by a predefinable distance of the opening from the top of the channel. In an advantageous refinement, it is proposed to reduce the height by an extension being fitted to the top of the channel, said extension reliably deflecting the impinging melt stream but being consumed by the melt itself during operation.

BRIEF DESCRIPTION OF THE DRAWINGS

An example of the invention is represented in the appended drawing, in which:

FIGS. 1.1, 1.2 and 1.3 show the sequence during the start of casting;

FIGS. 2.1, 2.2 and 2.3 show means for deflecting the melt stream in the casting channel;

FIGS. 3.1–3.2 show means for deflection in the opening area of the casting channel.

DETAILED DESCRIPTION OF THE PREFERRED EMBODIMENTS

FIGS. 1.1 to 1.3 show a melt feed vessel 11 to the bottom of which a submerged nozzle 12 is connected, whose inflow opening can be closed by a stopper 13.

The submerged nozzle 12 projects into a siphon-like vessel 21, which has a pouring chamber 22 and, separated by a dividing wall 23, a main chamber 24, to which a casting nozzle 25 is connected.

Downstream of the casting nozzle 25 there is a belt device having an endless belt 31, which has a driven roller 32 and a turn drum 33.

The main chamber 24 is connected to a vacuum pump 41, which is connected to a processor 71, as is a pressure meter 73. The processor 71 is also connected to a signal generator for the height of the strip 72 and to an actuator 74 for controlling the stopper 13.

FIG. 1 illustrates how the melt S flows from the melt feed vessel 11 into the pouring chamber 22 and at the same time into the main chamber 24 and, in so doing, over the top K of the siphon. As it flows out into the casting channel 26 the melt stream impinges on an elevated section 51 shaped like a ski jump and, at the same time, is deflected in such a way that a plug is produced inside the casting channel 26. A vacuum is generated by the pump 41 during its operation, said vacuum enlarging the plug and gradually filling up the casting channel 26. By means of increasing the vacuum further, as shown in FIG. 1.3, the main chamber 24 is largely filled with melt S and the level of melt in the pouring chamber 22 is reduced. When a stationary state of the strip height and of the level is reached, the pump 41 is switched off.

FIGS. 2.1 to 2.3 show means for deflecting the melt stream in the casting channel. In this case, an elevated section 51 that acts like a ski jump; is provided in FIG. 2.1, and its cross section is configured as a semicircle with a radius r.

In FIG. 2.2, that part facing the melt is configured with a radius R, and the part facing the opening is conical. As a result of the configuration, the melt stream is deflected in a defined way and the plug is formed reliably. During normal operation, this elevated section configured in this way is only a slight and therefore negligible obstacle in the casting channel.

In FIG. 2.3, the means for forming the plug is a magnet 56 fitted outside the casting channel 26.

FIGS. 3.1 and 3.2 illustrate configurations in which the plug is formed in the opening area. FIG. 3.1 illustrates by way of sketches the casting channel 26 and the underside 27 of the channel 26 and the top 28 of the channel 26 which, in the opening area 29, have a configuration such that the top 28 of the channel 26 has a distance H from the upper run 34 of the endless belt 31.

FIG. 3.1 illustrates how the melt stream S impinges on the upper run 34, bounces back from there and encounters the front of the top 28 of the channel and therefore forms a plug in the opening area.

In FIG. 3.2, the height H' can be reduced considerably by providing an extension 61. In FIG. 3.2, this extension 61 is fixed positively to the top 28 of the channel. When the melt stream S first encounters it, the extension 61 will deflect said stream, in order subsequently to be melted by the action of heat from the melt, and therefore to expose the complete height H for normal casting operation.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

The invention is not limited by the embodiments described above which are presented as examples only but can be modified in various ways within the scope of protection defined by the appended patent claims.

What is claimed is:

1. A method of starting to cast a metal strip close to its final dimensions, comprising the steps of:

leading a melt via a melt feed vessel into a pouring chamber of a siphon vessel;

leading the melt from the pouring chamber onto a cooled transport belt via a casting nozzle and a main chamber of the siphon vessel which can be put under vacuum;

filling the pouring chamber and the main chamber of the siphon vessel with the melt up to a top of the siphon;

before the melt flows over the top of the siphon, inducing a vacuum in the main chamber by actuating a vacuum device connected to the main chamber;

after the melt has flowed over the top of the siphon, leading the melt stream through the casting nozzle so that the nozzle cross section closes in a manner of a plug;

increasing the vacuum, depending on position of the plug in the casting nozzle, until there is in the melt stream a hydraulic connection between the stream inlet and the stream outlet, and adjusting the vacuum so that melt flows out of the opening of the casting nozzle; and keeping the melt level in the pouring chamber at a value at which an inflowing melt stream is equal to an outflowing melt stream.

2. A method as defined in claim 1, including spontaneously changing the flow direction of the melt stream at a predefinable point in the casting nozzle channel in order to form the plug.

3. A method as defined in claim 1, wherein the step of changing flow direction includes mechanically changing the flow direction.

4. A method as defined in claim 1, wherein the step of changing flow direction includes changing the flow direction with a magnetic field.

5. A method as defined in claim 1, including deflecting the flow direction of the melt stream after it has left the casting nozzle so that the plug forms in the opening area.

6. A method as defined in claim 1, including, after casting has been started, switching off the vacuum device, registering the height of the product produced and using the registered height directly via actuators for controlling the quantity of melt leaving the melt feed vessel.

7. A casting nozzle in a device for casting metal strip close to its final dimensions, which is connected to a main chamber which is connected to a vacuum device and to which metal melt can be fed via a pouring chamber, the pouring chamber being connected to a melt feed vessel provided with a shut-off device, the casting nozzle comprising:

a casting channel having an underside; and means for deflecting two-dimensional threads of melt flowing in on the underside of the casting channel, when casting is started with the casting channel not yet filled with melt, so that a plug forms in the casting channel.

8. A casting nozzle as defined in claim 7, wherein the deflecting means includes an elevated section provided on the underside of the casting channel of the casting nozzle.

9. A casting nozzle as defined in claim 7, wherein the elevated section has a diameter that describes a semicircular shape having a top that projects into an interior of the casting channel.

10. A casting nozzle as defined in claim 8, wherein the elevated section has a concave impingement surface pointing in a direction of the main chamber, and a downstream run-off face that runs out in a wedge shape within the casting channel.

11. A casting nozzle as defined in claim 7, wherein the deflecting means includes a switchable magnet arranged outside of the casting nozzle in a vicinity of the nozzle opening.

12. A casting nozzle as defined in claim 7, wherein the elevated section is shaped as a ski-jump.

13. A combination of a casting nozzle and a device for casting metal strip close to its final dimensions, the device comprising a main chamber which is connected to a vacuum device and to which metal can be fed via a pouring chamber, the pouring chamber being connected to a melt feed vessel provided with a shut-off device, and an endless belt having an upper run in a vicinity of the nozzle, the casting nozzle comprising a casting channel having an opening shaped, in relation to the upper run of the endless belt, to form a plug in the opening area, a distance of a top of the channel to the endless belt being smaller than a height of the cast stream.

14. A casting nozzle as defined in claim 13, and further comprising an extension fitted to a top wall of the casting channel, said extension consisting of a material which can be consumed by the melt.

* * * * *